US009499772B2

(12) United States Patent
Demmer et al.

(10) Patent No.: US 9,499,772 B2
(45) Date of Patent: Nov. 22, 2016

(54) METHODS OF DECONTAMINATING SURFACES AND RELATED COMPOSITIONS

(71) Applicants: Battelle Energy Alliance, LLC, Idaho Falls, ID (US); Environmental Alternatives, Inc., Keene, NH (US)

(72) Inventors: Ricky L. Demmer, Idaho Falls, ID (US); Daniel Crosby, Keene, NH (US); Christopher J. Norton, Spofford, NH (US)

(73) Assignee: BATTELLE ENERGY ALLIANCE, LLC, Idaho Falls, ID (US)

( * ) Notice: Subject to any disclaimer, the term of this patent is extended or adjusted under 35 U.S.C. 154(b) by 730 days.

(21) Appl. No.: 13/801,493

(22) Filed: Mar. 13, 2013

(65) Prior Publication Data

US 2015/0252303 A1 Sep. 10, 2015

(51) Int. Cl.

| | |
|---|---|
| ***C11D 3/32*** | (2006.01) |
| ***C11D 3/04*** | (2006.01) |
| ***C11D 3/065*** | (2006.01) |
| ***C11D 3/22*** | (2006.01) |
| ***C11D 3/26*** | (2006.01) |
| ***C11D 1/28*** | (2006.01) |
| ***G21F 9/16*** | (2006.01) |
| ***B08B 3/08*** | (2006.01) |
| ***B08B 3/12*** | (2006.01) |
| ***G21F 9/00*** | (2006.01) |

(52) U.S. Cl.

CPC . *C11D 3/32* (2013.01); *B08B 3/08* (2013.01); *B08B 3/12* (2013.01); *C11D 1/28* (2013.01); *C11D 3/042* (2013.01); *C11D 3/046* (2013.01); *C11D 3/048* (2013.01); *C11D 3/065* (2013.01); *C11D 3/222* (2013.01); *C11D 3/26* (2013.01); *G21F 9/002* (2013.01); *G21F 9/162* (2013.01); *G21F 9/167* (2013.01)

(58) Field of Classification Search

None

See application file for complete search history.

(56) References Cited

U.S. PATENT DOCUMENTS

| | | | | |
|---|---|---|---|---|
| 3,720,748 | A | 3/1973 | Massonne et al. | |
| 3,965,026 | A * | 6/1976 | Lancz | C11D 1/62 510/384 |
| 4,547,306 | A | 10/1985 | Hase et al. | |
| 4,850,729 | A | 7/1989 | Kramer et al. | |
| 5,254,290 | A | 10/1993 | Blandiaux et al. | |
| 5,402,893 | A * | 4/1995 | Keller | A24D 3/02 131/331 |
| 5,562,856 | A | 10/1996 | Jeschke et al. | |

(Continued)

FOREIGN PATENT DOCUMENTS

| | | | |
|---|---|---|---|
| CN | 102140313 | A * | 8/2011 |
| FR | 2 841 802 | A1 | 9/2004 |

(Continued)

OTHER PUBLICATIONS

English Machine Translation of CN 102140313 A.*

(Continued)

*Primary Examiner* — Nicole Blan

(74) *Attorney, Agent, or Firm* — TraskBritt

(57) ABSTRACT

A composition of matter includes water, at least one acid, at least one surfactant, at least one fluoride salt, and ammonium nitrate. A method of decontaminating a surface includes exposing a surface to such a composition and removing the composition from the surface. Other compositions of matter include water, a fatty alcohol ether sulfate, nitrilotriacetic acid, at least one of hydrochloric acid and nitric acid, sodium fluoride, potassium fluoride, ammonium nitrate, and gelatin.

25 Claims, 2 Drawing Sheets

(56) References Cited

U.S. PATENT DOCUMENTS 5,670,469 A 9/1997 Dingus et al.
5,679,661 A * 10/1997 Willey ..... A61L 2/18 514/63
5,864,767 A 1/1999 Drumgoole et al.
5,866,529 A 2/1999 Erilli
5,972,310 A 10/1999 Sachetto et al.
6,106,774 A 8/2000 Monticello et al.
6,284,721 B1 * 9/2001 Lee ..... C03C 15/00 134/2
6,333,054 B1 12/2001 Rogozinski
6,376,436 B1 4/2002 Cronce
6,405,626 B1 6/2002 Bureaux et al.
6,514,927 B2 2/2003 Lang et al.
6,525,237 B1 2/2003 Purdon et al.
6,562,090 B1 * 5/2003 Melbouci ..... A61K 8/19 424/49
6,652,661 B2 11/2003 Martin
6,723,890 B2 4/2004 Tucker et al.
6,903,057 B1 * 6/2005 Tsaur ..... A61K 8/732 424/70.1
7,070,773 B2 7/2006 Conerly et al.
7,166,758 B2 1/2007 Nunez et al.
7,662,754 B2 2/2010 Faure et al.
7,846,888 B2 * 12/2010 Demmer ..... A61L 2/22 510/110
2002/0107166 A1 * 8/2002 Morris ..... C11D 1/83 510/421
2003/0102007 A1 * 6/2003 Kaiser ..... B08B 3/12 134/1
2003/0171239 A1 * 9/2003 Patel ..... C11D 3/0094 510/406
2004/0055994 A1 3/2004 Miwa
2004/0265240 A1 12/2004 Tamarkin et al.
2005/0019421 A1 1/2005 Hobbs et al.
2005/0069566 A1 3/2005 Tamarkin et al.
2005/0239674 A1 10/2005 Dreja et al.
2006/0140984 A1 6/2006 Tamarkin et al.
2007/0185002 A1 8/2007 Demmer et al.
2008/0193427 A1 * 8/2008 Kaesler ..... A23G 3/366 424/93.45
2008/0286214 A1 * 11/2008 Brown ..... A61K 8/03 424/52
2009/0264330 A1 10/2009 Bruckner et al.
2010/0152089 A1 * 6/2010 Wattebled ..... C11D 1/83 510/337
2010/0189705 A1 7/2010 Squires et al.
2014/0024651 A1 1/2014 Volchek et al.

FOREIGN PATENT DOCUMENTS

WO 2009134294 11/2009
WO WO 2011053291 A1 * 5/2011 ..... A61K 8/20

OTHER PUBLICATIONS

PCT International Search Report and Written Opinion of the International Searching Authority for PCT/US2014/018298, dated May 22, 2014, 12 pages.
"Silv-Ex Plus 'Class A' Fire Control Concentrate," Ansul Data Sheet, <<www.ansul.com>> 2010, 2 pages.

* cited by examiner

METHODS OF DECONTAMINATING SURFACES AND RELATED COMPOSITIONS

GOVERNMENT RIGHTS

This invention was made with government support under Contract No. DE-AC07-05-ID14517, awarded by the United States Department of Energy. The government has certain rights in the invention.

FIELD

Embodiments of the present disclosure relate to compositions and methods for decontaminating surfaces. For example, compositions and methods disclosed herein may be used to remove nuclear, chemical, or biological contaminants.

BACKGROUND

To respond to nuclear, biological, or chemical emergencies, government agencies (i.e., local, state, and federal) must be adequately prepared to mitigate the hazards to the public and the environment in a timely manner. The clean-up of potentially toxic residue from terrorist events, such as the use of weapons of mass destruction (WMD), is of particular concern.

Radiological devices such as nuclear weapons and "dirty bombs" represent an increasingly dangerous threat to society, particularly when they contain materials with long radiological half-lives. To protect public health and safety, radiological materials released from such devices must be quickly and effectively contained. Once released, radiological materials present a decontamination problem because these materials may be deposited on surfaces of buildings, equipment, vehicles, and the ground.

Biological agents are typically particulate in nature and present a significant hazard long after an attack through formation of secondary aerosols. If inhaled, these aerosols may be particularly hazardous to humans and animals. Furthermore, biological agents may adhere to surfaces or be repositioned in the underlying environment and remain hazardous if disturbed. Thus, biological materials present a continuing decontamination problem when deposited on surfaces of buildings, equipment, vehicles, or the ground.

Chemical warfare agents include many classes of persistent (i.e., long-lasting) and semi-persistent agents. As a consequence, chemical warfare agents may pose a continuing hazard when deposited on surfaces of buildings, equipment, vehicles, or the ground.

Nuclear, biological, and chemical contamination may also occur due to accidents, forces of nature, or even routine use. For example, earthquakes and storms may pose risks to nuclear power plants or to chemical processing facilities. Uncontrolled releases of hazardous materials may endanger nearby and distant communities. Public health and safety may dictate removal or treatment of such hazardous materials.

Some compositions and methods for decontaminating surfaces are disclosed in U.S. Pat. No. 7,846,888, issued Dec. 7, 2010, assigned to the Assignee of the present application, and entitled "Long Lasting Decontamination Foam," the entire contents of which are incorporated herein by reference. Some methods disclosed therein include forming foam compositions having a surfactant and a gelatin, and with a pH of less than about 6. Contaminated surfaces may be treated with the foam to remove the contaminants.

BRIEF SUMMARY

In some embodiments, a composition of matter includes water, at least one acid, at least one surfactant, at least one fluoride salt, and ammonium nitrate. A method of decontaminating a surface includes exposing a surface to such a composition and removing the composition from the surface.

In other embodiments, a composition of matter includes water, a fatty alcohol ether sulfate, nitrilotriacetic acid, at least one of hydrochloric acid and nitric acid, sodium fluoride, potassium fluoride, ammonium nitrate, and gelatin. A method of decontaminating a surface includes exposing a surface to such a composition and removing the composition from the surface.

BRIEF DESCRIPTION OF THE DRAWINGS

While the specification concludes with claims particularly pointing out and distinctly claiming that which are regarded as embodiments of the present disclosure, advantages may be more readily ascertained from the following description when read in . conjunction with the accompanying drawings in which:

DETAILED DESCRIPTION

Figure 1:
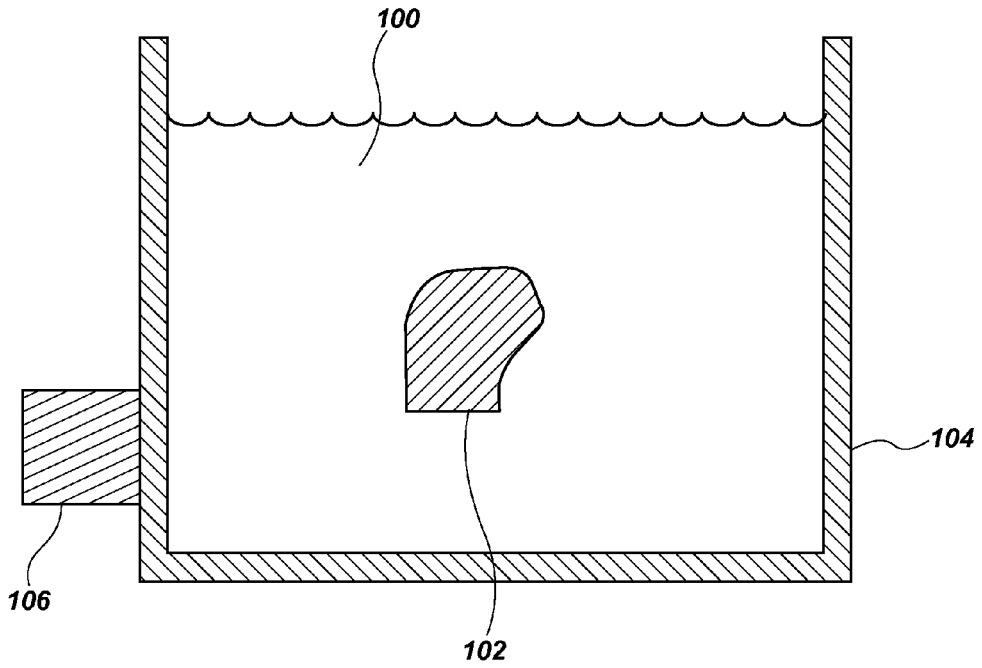
FIG. 1 is a simplified schematic showing how compositions of the present disclosure may be used in an ultrasonic bath to clean a contaminated part.

The illustrations presented herein are not meant to be actual views of any particular apparatus or system, but are merely idealized representations that are employed to describe various embodiments of the present disclosure. Elements common between figures may retain the same numerical designation.

The present disclosure describes compositions of matter and methods for decontaminating surfaces. In particular, the composition includes water, at least one acid, at least one surfactant, at least one fluoride salt, and ammonium nitrate. The composition may have a pH of less than about 7.0, such as a pH of less than about 6. The composition may be formulated to form a foam that is applied to surfaces. The composition may be used for cleaning surfaces, such as for removing nuclear, biological, or chemical contamination from the surfaces.

The composition may contain optional ingredients, such as gelatin or starch. The composition may also include other ingredients selected to aid in decontamination, such as strong acids, weak acids, salts, buffers, etc. One advantage of a composition of the present disclosure is that the composition may be composed of non-toxic ingredients having limited environmental impact. Forming a foam from such a composition significantly decreases the mass of the composition that must be used to treat a contaminated surface.

The composition may be an aqueous solution of at least one acid, at least one surfactant, at least one fluoride salt, and ammonium nitrate. The solution may include any ions or species, which may be selected to maintain the desired acidity. For convenience, the term "solution" is used herein to refer to a solution, suspension, emulsion, or dispersion of the ingredients in water. The compositions may include, for example, from about 40% to about 75% water.

For example, the composition may include ingredients selected such that the composition has a pH of less than about 6.0, such as a pH between about −0.5 and about 5.0. In some embodiments, the pH may be about 0.3 or about 4.5. The acid may include, but is not limited to, hydrochloric acid, nitric acid, citric acid, acetic acid, ethylenediaminetetraacetic acid (EDTA), (2-hydroxyethyl)ethylenediaminetriacetic acid (HEDTA), ethylene glycol-bis-(2-aminoethyl)-tetraacetic acid (EGTA), ammonium molybdophosphate (AMP), triethanolamine (TEA), nitrilotriacetic acid (NTA), or a combination thereof. The acid may be present at from about 4% by weight to about 60% by weight of the composition. For example, the acid may be present at from about 10% by weight to about 50% by weight of the composition, such as at about 46% by weight or at about 27% by weight. For example, in some embodiments, the composition may include from about 5% by weight to about 30% by weight hydrochloric acid, from about 0.03% by weight to about 2.0% by weight NTA, up to about 5.0% by weight citric acid, and up to about 3.0% by weight AMP. The acid may be provided in neat form or in an appropriate aqueous solution to achieve a selected concentration of acid. A person having ordinary skill in the art would understand how to select the amount of one or more concentrated or diluted acids to add to a composition to achieve a selected concentration of acid.

One or more of the acids of the composition may also function as a chelator, and may be formulated to form soluble complexes with metal ions. One or more of the acids may also function as affinity-shifting chemical (ASC) materials that change the ability of the solution to collect and retain larger concentrations of contaminants. ASCs are also mainly chelators that drive a chemical equilibrium such that a solution will accept higher concentrations of contaminants (e.g., by adjusting the pH). Examples of ASCs may include, for example, a combination of acetic acid and sodium acetate, EDTA, HEDTA, EGTA, AMP, TEA, citrate, and NTA. In one embodiment, the acid includes NTA. In another embodiment, the acid includes citric acid. In yet another embodiment, the acid includes hydrochloric acid. In one embodiment, the acid includes AMP. In even another embodiment, the acid includes a combination of NTA, citric acid, AMP, and hydrochloric acid.

As used herein, the term "surfactant" means and includes a compound having both a hydrophobic group and a hydrophilic group. The surfactant may be an anionic, nonionic, cationic, amphoteric, or zwitterionic surfactant, or a combination thereof.

Examples of anionic surfactants include, but are not limited to, soaps, alkyl benzene sulfonates, alkane sulfonates, olefin sulfonates, alkyl ether sulfonates, glycerol ether sulfonates, α-methyl ester sulfonates, sulfofatty acids, alkyl sulfates, fatty alcohol ether sulfates, glycerol ether sulfates, fatty acid ether sulfates (e.g., sodium lauryl sulfate (SLS), ammonium lauryl sulfate (ALS), sodium laureth sulfate, hydroxy mixed ether sulfates, monolgyceride (ether) sulfates, fatty acid amide (ether) sulfates, mono- and di-alkyl sulfosuccinates, mono- and di-alkyl sulfosuccinamates, sulfotriglycerides, amide soaps, ether carboxylic acids and salts thereof, fatty acid isethionates, fatty acid sarcosinates, fatty acid taurides, N-acylamino acids (e.g., acyl lactylates, acyl tartrates, acyl glutamates and acyl aspartates), alkyl oligoglucoside sulfates, protein fatty acid condensates (e.g., wheat-based vegetable products) and alkyl (ether) phosphates. Examples of nonionic surfactants include, but are not limited to, fatty alcohol polyglycol ethers, alkylphenol polyglycol ethers, fatty acid polyglycol esters, fatty acid amide polyglycol ethers, fatty amine polyglycol ethers, alkoxylated triglycerides, mixed ethers and mixed formals, alkenyl oligoglycosides or glucuronic acid derivatives (which may optionally be partly oxidized), fatty acid-N-alkyl glucamides, protein hydrolyzates (e.g., wheat-based vegetable products), polyol fatty acid esters, sugar esters, sorbitan esters, polysorbates and amine oxides. Examples of cationic surfactants include, but are not limited to, quaternary ammonium compounds such as dimethyl distearyl ammonium chloride, and esterquats such as quatemized fatty acid trialkanolamine ester salts. Examples of amphoteric or zwitterionic surfactants include alkylbetaines, alkylamidobetaines, amino-propionates, amino-glycinates, imidazolinium betaines, and sulfobetaines.

In some embodiments, a surfactant present in the composition includes a fire control concentrate commercially available under the trade name SILV-EX® from Ansul Inc., of Marinette, Wis. Such a concentrate includes a fatty alcohol ether sulfate, but may also include other ingredients, such as hydrocarbon surfactants, solvents, higher alcohols, and water. The surfactant may be present at from about 0.1% by weight to about 10% by weight of the composition. For example, the surfactant may be present at from about 0.5% by weight to about 5.0% by weight of the composition, such as at about 1.0% by weight.

As used herein, the term "fluoride salt" means and includes an ionic compound having a fluoride anion. For example, the fluoride salt includes sodium fluoride, potassium fluoride, magnesium fluoride, calcium fluoride, ammonium fluoride, or a combination thereof. The fluoride salt may be present at from about 0.1% by weight to about 10% by weight of the composition. For example, the fluoride salt may be present at from about 0.5% by weight to about 5.0% by weight of the composition, such as at about 2.0% by weight or at about 1.0% by weight. In one embodiment, the fluoride salt includes sodium fluoride. In another embodiment, the fluoride salt includes potassium fluoride. In yet another embodiment, the fluoride salt includes sodium fluoride, ammonium fluoride, and potassium fluoride.

The composition may also include ammonium nitrate. The ammonium nitrate may be present at from about 0.05% by weight to about 5% by weight of the composition. For example, the ammonium nitrate may be present at from about 0.1% by weight to about 3.0% by weight of the composition, such as at about 0.3% by weight or at about 0.5% by weight.

The composition may, optionally, include gelatin. As used herein, the term "gelatin" means and includes a protein product derived through a partial hydrolysis of collagen extracted from skin, bones, cartilage, ligaments, etc. Gelatin is commercially available from various sources, such as from Kraft Foods Group, Inc., of Northfield, Ill., under the trade name KNOX®. In some embodiments including gelatin, the gelatin may be present at from about 0.1% by weight to about 10% by weight of the composition, such as from about 1% by weight to about 3% by weight.

The presence or absence of gelatin, and the amount of gelatin in the composition, may be selected based on the intended use of the composition. For example, gelatin may be added to compositions intended to be formed into a foam onto a vertical surface, and in which a long residence time is desirable. Gelatin may be omitted or added in lesser amounts for compositions intended to be used as a cleaning solution in a bath (e.g., an ultrasonic bath), flushed as liquid through a conduit, applied as a mist onto a horizontal surface, etc. However, even without gelatin, compositions may still form a foam under certain circumstances, due to the presence of the surfactant.

Compositions disclosed herein may, optionally, include a vegetable starch. The starch may be added to thicken the compositions (i.e., increase viscosity), and may include potato starch, corn starch, etc. For example, compositions may include about 5% starch or less by weight or about 2% starch or less by weight.

In some embodiments, the composition may include the surfactant, nitrilotriacetic acid, hydrochloric acid, sodium fluoride, corn starch, citric acid, ammonium nitrate, potassium fluoride, ammonium molybdophosphate, and water, such as approximately 1.3% by weight surfactant, approximately 0.03% to 1.0% (e.g., 0.1%) by weight nitrilotriacetic acid, approximately 27.0% by weight hydrochloric acid, approximately 0.2% by weight sodium fluoride, approximately 0.2% by weight corn starch, approximately 0.2% by weight citric acid, approximately 0.3% by weight ammonium nitrate, approximately 1.0% by weight potassium fluoride, approximately 0.2% by weight ammonium molybdophosphate, and the balance water.

In other embodiments, the composition may include the surfactant, nitrilotriacetic acid, hydrochloric acid, sodium fluoride, corn starch, citric acid, ammonium nitrate, potassium fluoride, ammonium molybdophosphate, gelatin, and water, such as approximately 1.3% by weight surfactant, approximately 0.03% to 1.0% by weight nitrilotriacetic acid, approximately 27.0% by weight hydrochloric acid, approximately 0.2% by weight sodium fluoride, approximately 0.2% by weight corn starch, approximately 0.2% by weight citric acid, approximately 0.3% by weight ammonium nitrate, approximately 1.0% by weight potassium fluoride, approximately 0.2% by weight ammonium molybdophosphate, approximately 1.0% by weight gelatin, and the balance water.

Compositions disclosed herein may be formed by mixing, heating, cooling, or other processes. For example, water and an acid (which may be provided as a single ingredient (i.e., a diluted acid) or by mixing concentrated acid with water) may be mixed with the at least one surfactant, the at least one fluoride salt, and ammonium nitrate, as well as with any other ingredients. The ingredients may be mixed simultaneously or in steps. Mixing of some ingredients may be exothermic or endothermic, and the mixture may be heated or cooled to maintain a selected temperature and/or to promote mixing. Air or another gas may be injected into the compositions to form bubbles. The air or another gas may also promote mixing of ingredients.

The compositions described herein may be applied to solid surfaces for removing contaminants from the surface, such as chemical, biological, or nuclear contaminants. The compositions may be applied to a variety of surfaces and materials, such as concrete, cinder block, brick, tile, glass, asphalt, fiber cement board, wood, cast iron, steel, stainless steel, and other metals, including exotic metals, to remove contaminants therefrom.

In some embodiments and as shown in FIG. 1, the composition may be used as a cleaning solution 100 in a vessel 104. The cleaning solution 100 may be a composition as described above. A contaminated part 102 (e.g., a relatively small part) may be immersed in the cleaning solution 100 within the vessel 104. The contaminated part 102 may include nuclear, biological, or chemical contaminants on a surface thereof. The cleaning solution 100 may contact multiple exterior surfaces of the contaminated part 102, and may optionally contact interior surfaces of the contaminated part 102. The contaminated part 102 may be suspended in the cleaning solution 100 by one or more brackets, wires, etc. (not shown), or may rest on the floor of the vessel 104. A transducer 106 may optionally deliver energy to the cleaning solution 100, such as ultrasonic energy. The energy may promote mixing of the ingredients of the cleaning solution 100 and increase interactions between the cleaning solution 100 and the contaminated part 102. The ingredients of the cleaning solution 100, in combination with the ultrasonic energy, may loosen the contaminants adhered to the surfaces of the contaminated part 102. The cleaning solution 100 as shown in FIG. 1 may be particularly suitable to removing contaminants from removable or separable parts and parts of sufficiently small size that they may be economically and safely immersed in the cleaning solution 100.

Figure 2:
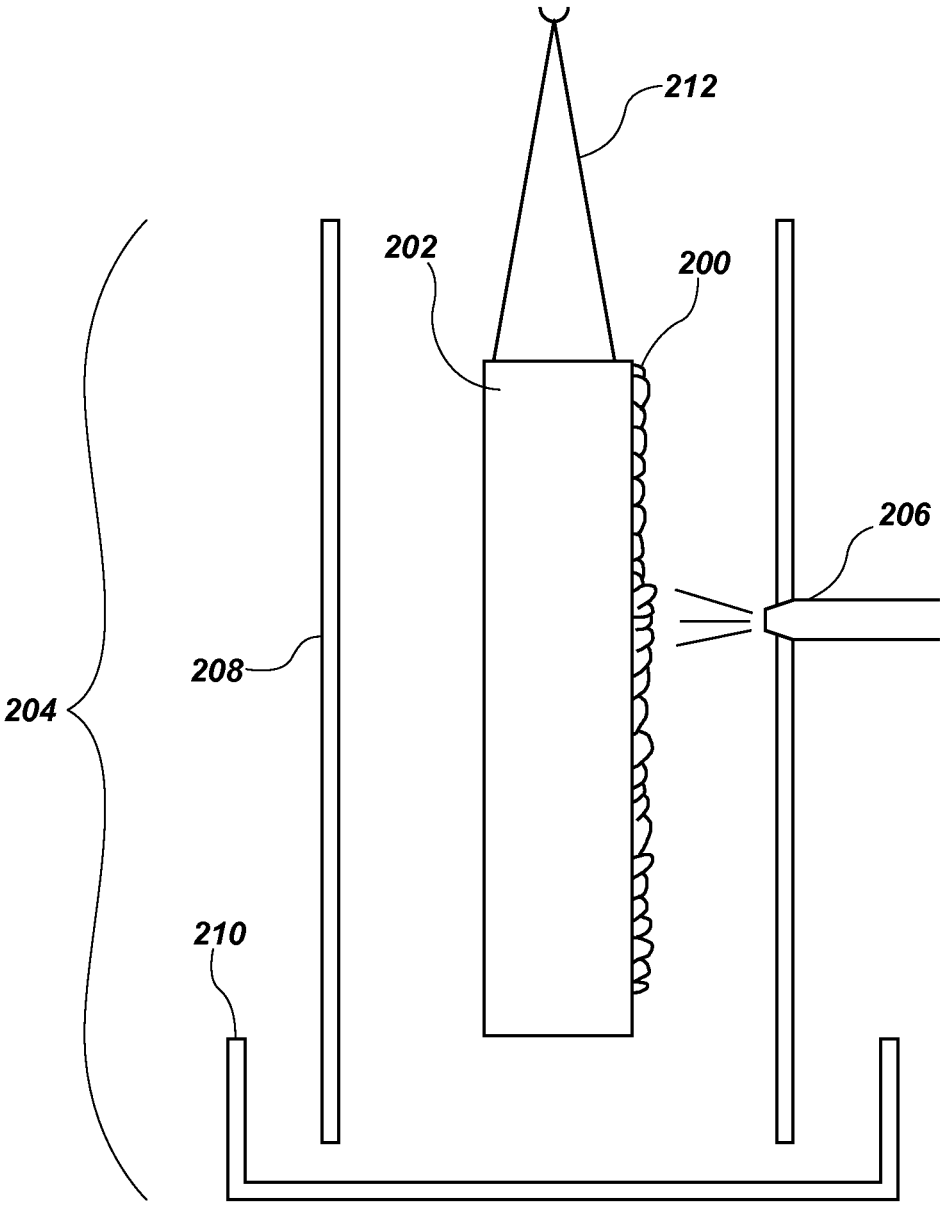
FIG. 2 is a simplified schematic showing how compositions of the present disclosure may be sprayed onto a contaminated part.

In some embodiments and as shown in FIG. 2, the composition may be used as a cleaning foam 200. The cleaning foam 200 may be formed by injecting air or other gas into a volume of one of the compositions described above via a glass frit. The injected gas forms bubbles and increases the specific volume of the composition. The cleaning foam 200 may be applied to a contaminated part 202, such as by spraying, within a vessel 204. For instance, the cleaning foam 200 may be sprayed through a spray nozzle 206. The cleaning foam 200 may be sprayed onto one or more exposed surfaces of the contaminated part 202. The vessel 204 may protect nearby personnel, equipment, and surfaces from overspray of the cleaning foam 200. For example, the vessel 204 may include a curtain 208 and a basin 210. The contaminated part 202 may be suspended within the vessel 204, such as by cables 212, straps, chains, etc. Alternatively, the contaminated part 202 may rest on the bottom of the vessel 204. The cleaning foam 200 may remove contaminants from the exposed surfaces of the contaminated part 202. The cleaning foam 200 as shown in FIG. 2 may be particularly suitable to removing contaminants from parts not easily removed or separated from equipment and parts too large for immersion in the vessel 104 shown in FIG. 1.

The cleaning foam 200 shown in FIG. 2 may deliver the ingredients of the composition to surfaces of the contaminated part 202. In addition, the cleaning foam 200 may be formulated to remain in contact with the surfaces of the contaminated part 202, even on vertical surfaces, for a period of time to promote the removal of contaminants from the contaminated part 202. For example, the cleaning foam 200 may be formulated to remain on surfaces of the contaminated part 202 for at least 10 minutes, at least 30 minutes, at least 60 minutes, or even at least 120 minutes. Use of the composition as a cleaning foam 200 may reduce the amount (i.e., mass) of the composition necessary to coat surfaces of the contaminated part 202, because the cleaning foam 200 includes a volume of gas in the composition. Thus, the mass of the cleaning foam 200 may be relatively small compared to the mass of a comparable volume of the composition from which the cleaning foam 200 was formed.

After the contaminated part 202 has been exposed to the cleaning foam 200 for a period of time, the cleaning foam 200 may be removed from the contaminated part 202. For example, the cleaning foam 200 may be removed by vacuuming or wiping surfaces of the contaminated part 202 or by rinsing the contaminated part 202 with water or another fluid. The composition from which the cleaning foam 200 is formed may be water-soluble, and the cleaning foam 200 may be removed by rinsing with water. Effluent material including the cleaning foam 200 may be captured in the vessel 204 and treated as low-grade hazardous waste, depending on the type and amount of contaminant on the contaminated part 202.

In some embodiments, the cleaning foam 200 may be applied to walls, ceilings, structural beams, piping, tools, or any other objects or surfaces. In some embodiments, the vessel 204 shown in FIG. 2 may be omitted, such as when the cleaning foam 200 is used to clean a contaminated wall or a large object not easily disposed in a vessel. In such embodiments, containing the effluent material may include vacuuming, forming a dam, etc.

In some embodiments, a composition as described herein may be applied to a surface without forming a foam. For example, the composition may be applied as a mist or spray over a horizontal surface.

Exposure of contaminated surfaces to the compositions described herein may result in the reduction of contaminants on the surfaces by at least 50%, at least 75%, at least 90%, at least 95%, at least 98%, or even at least 99%. The effectiveness of contaminant removal may vary based on the ingredients in the composition (e.g., the identity of acids), the amounts of ingredients in the composition (including the presence or absence of a gas to produce the foam), the exposure time, temperature, the type and amount of contamination, etc. The compositions described herein may be effective for the removal of nuclear, biological, or chemical contaminants. For example, the compositions may effectively remove hydrocarbons or transuranic radioactive materials.

One measure of performance of a composition is the aggressiveness of corrosion on a contaminated part or surface being cleaned. Decontamination is often the balance of corroding metal just enough to release the contamination from the surface. The corrosion rates of compositions described herein may be higher than conventional compositions, thus increasing the potential for decontamination over conventional compositions.

EXAMPLES

Comparative Example 1

A control composition was prepared to decontaminate mechanical parts exposed to radioactive materials. The composition included the ingredients and amounts shown in Table 1, below. Gelatin was added to water and heated to near boiling for a short time (just long enough to dissolve the gelatin) and cooled to room temperature. The surfactant, nitrilotriacetic acid, and hydrochloric acid were mixed together with the water and gelatin in a vessel at room temperature until the mixture was homogeneous. The nitrilotriacetic acid was added as a saturated solution, and a portion of the water in the composition shown in Table 1 was the solvent for the nitrilotriacetic acid. The corn starch, citric acid, ammonium molybdophosphate, were then mixed into the vessel. The mixture was maintained at approximately 20° C. during mixing.

TABLE 1

Conventional decontamination composition

| Ingredient | Amount |
|---|---|
| SILV-EX ® surfactant | 1.5% |
| nitrilotriacetic acid | 0.1% |
| hydrochloric acid | 10.0% |

TABLE 1-continued

Conventional decontamination composition

| Ingredient | Amount |
|---|---|
| corn starch | 1.0% |
| citric acid | 5.0% |
| ammonium molybdophosphate | 1.0% |
| gelatin | 1.0% |
| water | balance |

The composition was a liquid having a pH of about 0.5 at room temperature, and was applied to the parts by injecting air through a glass frit into a container of the liquid. The air-formed bubbles of the liquid and the resulting foam was applied to surfaces of the contaminated parts.

The foam was removed from the surfaces after 90 minutes. Approximately 94% of the radioactive material on the surfaces was removed by the foam. The radioactive material included cesium-137, lanthanum-140, plutonium-239, strontium-85 and cobalt-60.

Example 2

A composition including ammonium nitrate and fluoride salts was prepared to decontaminate mechanical parts exposed to radioactive materials. The composition included the ingredients and amounts shown in Table 2, below. The water, surfactant, nitrilotriacetic acid, and hydrochloric acid were mixed together in a vessel at room temperature until the mixture was homogeneous. The nitrilotriacetic acid was added as a saturated solution, and a portion of the water in the composition shown in Table 2 was the solvent for the nitrilotriacetic acid. The sodium fluoride, corn starch, citric acid, ammonium nitrate, potassium fluoride, and ammonium molybdophosphate were then mixed into the vessel. The mixture was maintained at approximately 20° C. during mixing.

TABLE 2

Decontamination composition including ammonium nitrate and fluoride salts

| Ingredient | Amount |
|---|---|
| SILV-EX ® surfactant | 1.3% |
| nitrilotriacetic acid | 0.1% |
| hydrochloric acid | 27.0% |
| sodium fluoride | 0.20% |
| corn starch | 0.20% |
| citric acid | 0.20% |
| ammonium nitrate | 0.30% |
| potassium fluoride | 1.0% |
| ammonium molybdophosphate | 0.20% |
| water | balance |

The composition was a liquid having a pH of about 0.5 at room temperature, and was applied to the parts by injecting air through a glass frit into a container of the liquid. The air formed bubbles of the liquid, and the resulting foam was applied to surfaces of the contaminated parts.

The foam was removed from the surfaces after 90 minutes. Approximately 98% of the radioactive material on the surfaces was removed by the foam. The radioactive material included cesium-137, plutonium-239, uranium-238, strontium-85 having a beta activity dose rate of about 40 Rad/hr. After treatment with the foam, the parts had a beta activity dose rate of about 0.5 Rad/hr.

Example 3

A composition including ammonium nitrate and fluoride salts was prepared to determine the potential degradation of mechanical parts during decontamination. The composition included the components and amounts shown in Table 3, below. The water, surfactant, nitrilotriacetic acid, and hydrochloric acid were mixed together in a vessel at room temperature until the mixture was homogeneous. The nitrilotriacetic acid was added as a saturated solution, and a portion of the water in the composition shown in Table 3 was the solvent for the nitrilotriacetic acid. The sodium fluoride, corn starch, citric acid, ammonium nitrate, potassium fluoride, and ammonium molybdophosphate were then mixed into the vessel. The mixture was maintained at approximately 20° C. during mixing.

TABLE 3

Decontamination composition including ammonium nitrate and fluoride salts

| Ingredient | Amount |
|---|---|
| SILV-EX ® surfactant | 1.3% |
| nitrilotriacetic acid | 0.1% |
| hydrochloric acid | 27.0% |
| sodium fluoride | 0.20% |
| corn starch | 0.20% |
| citric acid | 0.20% |
| ammonium nitrate | 0.30% |
| potassium fluoride | 1.0% |
| ammonium molybdophosphate | 0.20% |
| water | balance |

The composition was a liquid having a pH of about 0.5 at room temperature. An uncontaminated metal assembly of aluminum and steel was immersed in the composition in an ultrasonic bath at a temperature of 20° C. for ten minutes, then immersed in deionized water in another ultrasonic bath for another five minutes. The ultrasonic baths provided about 100 W at a frequency of about 60 kHz. After these baths, the assembly was disassembled to check for corrosion. Though some parts of the assembly were discolored, no significant degradation was observed.

Example 4

A composition including ammonium nitrate and fluoride salts was prepared as in Example 3, having the ingredients shown in Table 3, above.

A contaminated metal assembly including a manipulator tong and a manipulator wrist was immersed in an ultrasonic bath at a temperature of 20° C. for ten minutes, then immersed in deionized water in another ultrasonic bath for five minutes. The ultrasonic baths provided about 100 W at a frequency of about 60 kHz. The radiation levels on each part were measured before and after treatment, and are shown in Table 4, below.

TABLE 4

Radiation levels on manipulator assembly

| Part | Gamma dose (mRad/hr) | Corrected beta dose (mRad/hr) |
|---|---|---|
| Manipulator tong (before treatment) | 6 | 2982 |
| Manipulator wrist (before treatment) | 12 | 5964 |
| Manipulator tong (after treatment) | 6 | 27 |
| Manipulator wrist (after treatment) | 8 | 25 |

After testing the radiation levels, the manipulator wrist was disassembled. Only minor corrosion was noted, and there was no substantial corrosion of fine, critical-tolerance parts. The corrected beta dose decreased by greater than 99% for each part. The treatment decreased the radiation dose, thus decreasing the overall radiation released in a given amount of exposure time. This reduction may allow the assembly to be repaired or reconditioned instead of discarded, because the radiation dose to which a worker is exposed while repairing a treated assembly is lower than the radiation dose to which the worker would be exposed performing the same work on an untreated assembly. Thus, an assembly having too high a radiation level to safely repair may be treated to lower the radiation level enough that the repairs may be completed.

Example 5

A composition including ammonium nitrate and fluoride salts was prepared as in Example 3, having the ingredients shown in Table 3, above.

The composition was a liquid at room temperature, and was applied to a contaminated metal assembly including a manipulator slave arm and a manipulator wrist. The assembly was suspended by an overhead crane within a plastic shower curtain to control overspray and over a small barrel to collect waste. The liquid was applied to the assembly through garden-type sprayers. After application of the liquid, the assembly was rinsed with deionized water. The radiation levels on each part were measured before and after treatment, and are shown in Table 5, below.

TABLE 5

Radiation levels on manipulator assembly

| Part | Gamma dose (mRad/hr) | Corrected beta dose (mRad/hr) |
|---|---|---|
| Manipulator slave thin top (before treatment) | 500 | 1500 |
| Manipulator slave arm middle (before treatment) | 100 | 2700 |
| Manipulator slave wrist (before treatment) | 1200 | 41,400 |
| Manipulator slave arm top (after treatment) | 50 | 450 |
| Manipulator slave anti middle (after treatment) | 50 | 450 |
| Manipulator slave wrist (after treatment) | 50 | 450 |

This test showed that application of the cleaning liquid rapidly reduced radiation levels on contaminated parts. The cleaning process took approximately two hours and produced less than 2 gallons (less than 8 liters) of waste, including the cleaning liquid and rinse water. The waste was solidified with a dry granular material (ACID-BOND A660™, available from Crestline Industries, of Owings Mills, Md.) and disposed of as low-level radioactive waste.

While the disclosure may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the scope of the disclosure as defined by the following appended claims and their legal equivalents.

What is claimed is:

1. A composition, comprising:

water;

at least one chelator selected from the group consisting of ethylenediaminetetraacetic acid, (2-hydroxyethyl)ethylenediaminetriacetic acid, ethylene glycol-bis-(2-aminoethyl)-tetracetic acid, ammonium molybdophosphate, and nitrilotriacetic acid;

at least one of hydrochloric acid or nitric acid;
at least one surfactant comprising a fatty alcohol ether sulfate;
at least one fluoride salt; and
ammonium nitrate.

2. The composition of claim 1, further comprising gelatin.

3. The composition of claim 1, further comprising corn starch.

4. The composition of claim 1, wherein the fatty alcohol ether sulfate comprises at least one of a sodium salt of the fatty alcohol ether sulfate or an ammonium salt of the fatty alcohol ether sulfate.

5. The composition of claim 1, wherein the at least one surfactant is present at from about 0.1% by weight to about 10% by weight.

6. The composition of claim 1, wherein:
the at least one chelator comprises nitrilotriacetic acid; and
the at least one fluoride salt comprises at least one of sodium fluoride or potassium fluoride.

7. The composition of claim 6, further comprising gelatin.

8. The composition of claim 6, further comprising corn starch.

9. The composition of claim 1, wherein:
the water comprises from about 40% by weight to about 50% by weight of the composition;
the at least one chelator comprises from about 4% by weight to about 60% by weight of the composition;
the at least one surfactant comprises from about 0.1% by weight to about 10% by weight of the composition;
the at least one fluoride salt comprises from about 0.1% by weight to about 10% by weight of the composition; and
the ammonium nitrate comprises from about 0.05% by weight to about 5.0% by weight of the composition.

10. The composition of claim 1, wherein the composition comprises water, nitrilotriacetic acid, hydrochloric acid, ammonium molybdophosphate, the fatty alcohol ether sulfate, sodium fluoride, potassium fluoride, and ammonium nitrate.

11. The composition of claim 1, wherein the composition comprises water, nitrilotriacetic acid, citric acid, hydrochloric acid, ammonium molybdophosphate, the fatty alcohol ether sulfate, sodium fluoride, potassium fluoride, and ammonium nitrate.

12. The composition of claim 1, wherein the pH of the composition is between about -0.5 and about 5.

13. The composition of claim 1, wherein the composition is formulated to generate a foam.

14. The composition of claim 1, wherein a pH of the composition is less than about 6.

15. A composition, comprising:
water;
a fatty alcohol ether sulfate;
nitrilotriacetic acid;
hydrochloric acid;
sodium fluoride;
potassium fluoride;
ammonium nitrate; and
gelatin.

16. The composition of claim 15, further comprising corn starch, citric acid, and ammonium molybdophosphate.

17. The composition of claim 15, wherein the composition comprises from about 0.03% by weight to about 1% by weight of nitrilotriacetic acid.

18. The composition of claim 15, wherein the composition comprises from about 20% by weight to about 35% by weight of hydrochloric acid.

19. A composition consisting essentially of:
water;
a fatty alcohol ether sulfate;
nitrilotriacetic acid;
hydrochloric acid;
sodium fluoride;
corn starch;
citric acid;
ammonium nitrate;
potassium fluoride;
ammonium molybdophosphate; and
gelatin.

20. A method of decontaminating a surface, comprising:
exposing a surface to a composition, the surface having a radioactive contaminant material thereon and the composition comprising:
water;
at least one acid;
at least one surfactant;
at least one fluoride salt; and
ammonium nitrate; and
removing at least a portion of the composition from the surface to remove at least a portion of the radioactive contaminant material from the surface.

21. The method of claim 20, wherein removing at least a portion of the radioactive contaminant material from the surface further comprises removing biological contaminant materials or chemical contaminant materials from the surface.

22. The method of claim 20, further comprising applying ultrasonic energy to the composition.

23. The method of claim 20, further comprising injecting a gas into the composition to produce a foam before exposing the surface to the composition.

24. The method of claim 20, wherein exposing the surface to a composition comprises exposing the surface to a composition comprising water, a fatty alcohol ether sulfate, nitrilotriacetic acid, hydrochloric acid, sodium fluoride, potassium fluoride, and ammonium nitrate.

25. The method of claim 20, wherein exposing a surface to a composition comprises exposing the surface to a composition wherein:
the water comprises from about 40% by weight to about 50% by weight of the composition;
the at least one acid comprises from about 20% by weight to about 60% by weight of the composition;
the at least one surfactant comprises from about 0.1% by weight to about 10% by weight of the composition;
the at least one fluoride salt comprises from about 0.1% by weight to about 10% by weight of the composition; and
the ammonium nitrate comprises from about 0.05% by weight to about 5.0% by weight of the composition.

* * * * *